United States Patent [19]

Robinson

[11] 4,205,581

[45] Jun. 3, 1980

[54] KEYER SYSTEM

[75] Inventor: John W. Robinson, Jasper, Ind.

[73] Assignee: Kimball International, Inc., Jasper, Ind.

[21] Appl. No.: 892,385

[22] Filed: Mar. 31, 1978

Related U.S. Application Data

[63] Continuation of Ser. No. 736,256, Oct. 27, 1976, abandoned.

[51] Int. Cl.[2] ..... G10H 1/02

[52] U.S. Cl. ..... 84/1.26; 84/DIG. 23; 84/DIG. 8

[58] Field of Search ..... 84/1.01, 1.03, 1.13, 84/1.24, 1.26, DIG. 8, DIG. 23

[56] References Cited

U.S. PATENT DOCUMENTS

| | | | |
|---|---|---|---|
| 3,557,297 | 1/1971 | Matsuura | 84/1.26 |
| 3,565,999 | 2/1971 | Bunger | 84/1.26 |
| 3,665,091 | 5/1972 | Hirano | 84/1.26 |
| 3,746,775 | 7/1973 | Uchiyama | 84/1.26 |
| 3,755,609 | 8/1973 | Millet | 84/1.23 |
| 3,861,263 | 1/1975 | Okudaira | 84/1.01 |
| 3,999,456 | 12/1976 | Tsunoo | 84/1.01 |
| 4,051,469 | 9/1977 | Ninomiya | 340/347 AD |

*Primary Examiner*—J. V. Truhe
*Assistant Examiner*—William L. Feeney
*Attorney, Agent, or Firm*—Albert L. Jeffers; John F. Hoffman

[57] ABSTRACT

An organ keyer system, especially a keyer system operated by logic level signals, such as occur in multiplexing.

The keyer system herein described is especially intended for manufacture by large scale integration techniques, and is designed to provide for the controlled attack and decay of the keyed signal without the use of timing components, such as resistor and capacitors, external to the integrated circuit.

28 Claims, 3 Drawing Figures

KEYER SYSTEM

This is a continuation of application Ser. No. 736,256, filed Oct. 27, 1976, now abandoned.

BACKGROUND OF THE INVENTION

Electronic organs include tone generating means connected to supply electric tone signals to keyers, and then to an audio system, while the keyers are activated by control signals obtained by electronically scanning a set of keyboard actuated switches. The operation of keyers by control signals derived by the electronic scanning of keyboard switches makes it possible to manipulate the control signals and thereby control the rate of attack, and/or decay, of the keyer activating signals.

A method commonly used to control the rate of attack or decay of a keyer control signal employs a capacitor-resistor network having a desired time constant. The keyer control signal is obtained by the voltage impressed upon the capacitor which will discharge at a controlled rate, as determined by the parameters of the network.

A further advantage of the technique of electronically scanning keyboard operated switches has been the ability to incorporate portions of the circuit of electronic organs within large scale integrated circuit chips. As the state of the art of electronic organs continues to mature, greater and greater portions of the circuit of electronic organs are produced by the method of large scale integration.

The method of controlling the keyer control signals by the use of a timing capacitor-resistor network, however, has required the continued use of capacitors external to integrated circuit chips because of the capacitor values required.

Therefore, it is an objective of the present invention to produce an organ keyer system in which the entire keyer control circuit can be manufactured on a single integrated circuit chip, without the necessity of any external timing capacitor.

It is a further objective of the present invention to develop an organ keyer system which can be inexpensively produced by the method of large scale integration.

BRIEF SUMMARY OF THE INVENTION

The circuit of the present invention constitutes an organ keyer system intended for use with electronic organs, especially multiplex organs which employ the technique of electronically scanning a group of keyboard operated switches, and developing keyer control signals by the use of logic circuits.

The circuit of the present invention is intended for insertion within such an organ between the output of the logic circuit used to develop the keyer signals and the keyer control terminals.

In an organ of the type stated, the key operated switches are electronically scanned by multiplexing means, and a data stream is developed which is connected to the input of a demultiplexer circuit. The demultiplexer circuit will contain, for instance, a shift register with the output terminals of the shift register connected to the inputs of a multiple bit latch. Each time the multiplexer cycles through a complete scan of the keyboard switches, the latch is clocked, transferring the signals at the output of the shift register to the outputs of the latch. The outputs of the latch will contain keyer operating signals, and each of the outputs of the latch is connected to the input to keyer control circuit, and the output of the keyer control circuit generates the keying input to each of a group of keyers.

The present invention consists of, in particular, a circuit and method for controlling the rate of change of the keyer control voltage and, therefore, the attack and decay envelope of the keyed tone.

The rate of change of the key voltage is controlled within the circuit of the present invention by the use of a pair of field effect transistors (FETs) and a pair of capacitors. The FETs are connected in series with a first one of the pair of capacitors connected to the common terminal of the transistors, and the second of the pair of capacitors is connected to the second terminal of a first one of the pair of transistors, while the keyer actuating signal from the organ logic circuit is connected to the second terminal of the second one of the pair of transistors.

Each of the pair of transistors are provided with a gate terminal which controls the impedance of the transistor between the previously mentioned first and second terminals. Gating signals are supplied to the gate of each of the pair of transistors alternately with the frequency of the alterations of the gating signals determining the relative time constant established from the initial onset of the keyer activating signal from the logic circuit to the development of the keyer control voltage at the output of the control circuit.

The control voltage developed on the second of the pair of capacitors is connected to the gating terminal of a third FET which forms the keyer means of the keying system.

The objects and advantages of the circuit of the present invention will be more fully understood by reference to the following detailed specification taken in connection with the accompanying drawings in which.

DETAILED DESCRIPTION OF THE INVENTION

The circuit of the present invention is related to a method for controlling the attack and decay of keyer control signals and is designed for insertion in an organ circuit between a source of keyer operating signals and keyer control terminals.

Accordingly, the major portion of the organ circuit, and which includes the keyboard manual, multiplexing circuit and demultiplexing circuit, tone generating means, and voicing amplification and transducer means, will not be discussed herein in detail. Each of the components listed above can be of a conventional nature, as can be found in any multiplexed organ.

Figure 1:
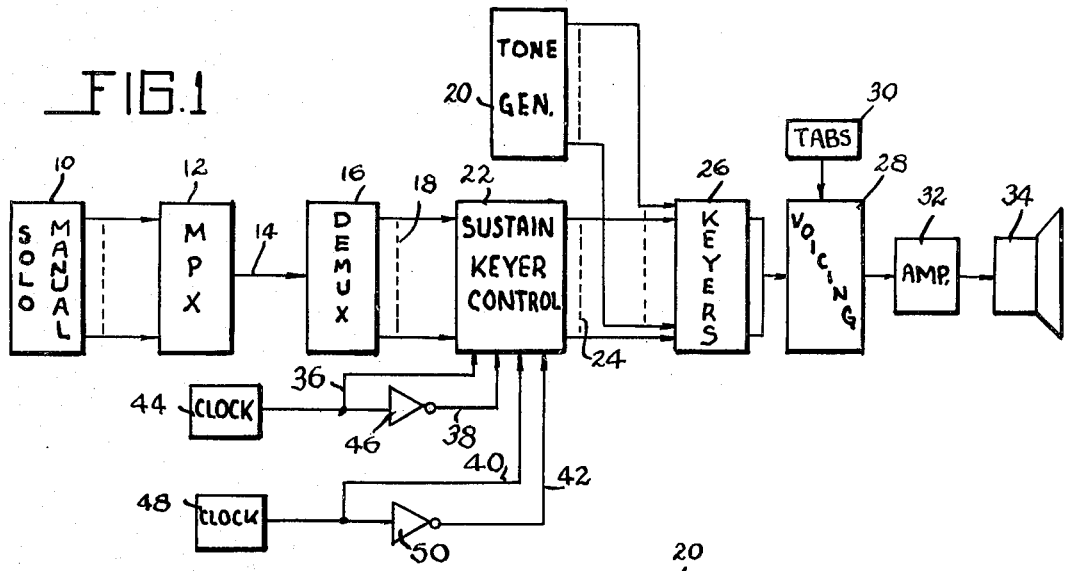
FIG. 1 is a simplified block diagram of a portion of an organ circuit embodying the circuit of the present invention.

Referring to FIG. 1, a solo manual 10 is addressed by multiplexer circuit 12 to produce a data stream on wire 14 which is connected to the input of a demultiplexer circuit 16. Demultiplexer circuit 16 develops a multiple bit output on lines 18 for each tone output of a tone generator 20. The logic level developed on each line 18 is used to control the keying of a respective tone signal of tone generator 20. Output lines 18 of the demultiplexer circuit 16 are connected to the inputs of a psuedo sustain circuit 22. Circuit 22 has a multiple bit output on lines 24, equal in number to lines 18.

Output lines 24 are connected to the control terminals of a group of keyers 26. A logic level zero signal developed on a line 18 will activate the sustain control 22 which will supply an exponentially changing signal to a corresponding one of lines 24 which will actuate a respective one of keyers 26. When a keyer is activated, a respective tone is supplied to the input of a voicing circuit 28 which will shape the signals in conformity with the settings of tabs 30. The shaped tone signal from voicing circuit 28 is amplified by amplifier 32 and converted to audible music by speaker 34.

Returning briefly to psuedo sustain circuit 22, it will be noted that four additional inputs to circuit 22 are shown in FIG. 1, and are labeled 36, 38, 40 and 42, respectively.

A source of clock pulses 44 is provided, as shown in FIG. 1, with the output terminal thereof connected to input 36 of circuit 22. Source 44 is also connected to the input of an inverter 46, the output of which forms input 38 of circuit 22.

Similarly, a source of clock pulses 48 is connected to input 40 to circuit 22, and through inverter 50 to input 42 of circuit 22.

The clock signals developed by clock 44 and clock 48 are used within circuit 22 to control the rate of attack, and the rate of decay, of the keyer actuating or control signals developed on lines 24 in response to the development of keying signals on lines 18 of demultiplexer circuit 16.

Figure 2:
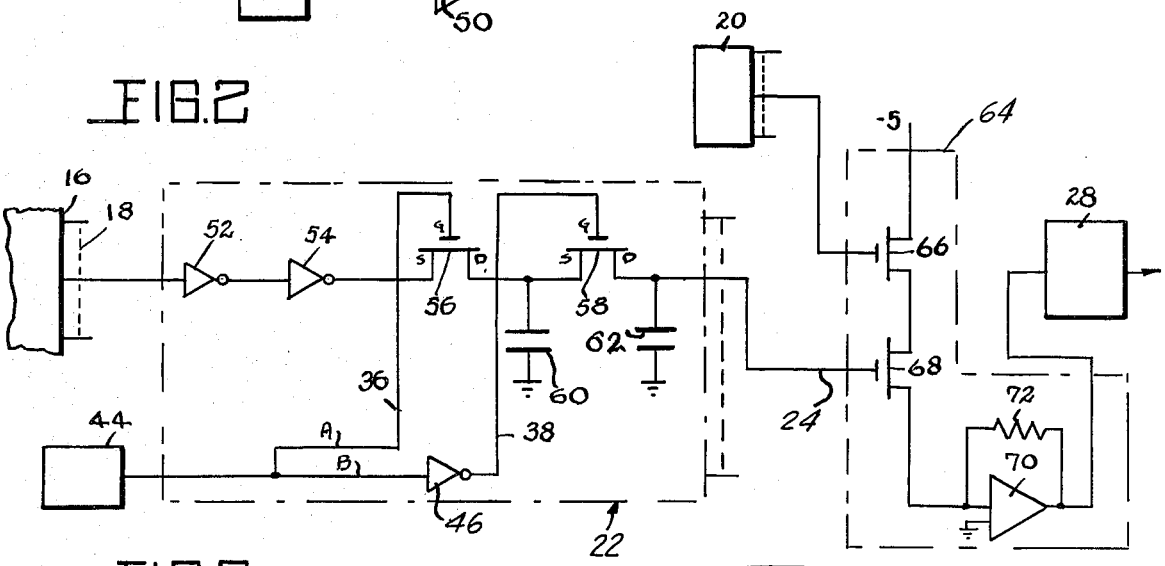
FIG. 2 is a schematic showing of a simplified version of the circuit of the present invention.

The method by which the clock signals developed by clocks 44 and 48 are used within circuit 22 can more easily be understood by reference to FIG. 2 in which a single one, or portion, of the circuits within circuit 22 is shown.

To simplify the initial explanation of the operation of each portion of circuit 22, the circuit as shown in FIG. 2 is shown with connections to clocking inputs 36 and 38 only.

Each line 18 of demultiplexer circuit 16 is connected to the input of one portion of circuit 22. One such portion of circuit 22 is as shown in FIG. 2, and consists of an inverter 52 with the input of inverter 52 connected to the corresponding line 18 of demultiplexer 16. The output of inverter 52 is connected to the input of a second inverter 54. Inverter 54 is connected to the source terminal of the field effect transistor (FET) 56. The drain terminal of transistor 56 is connected to the source terminal of a second field effect transistor 58, with the drain terminal of FET 58 connected to a respective line 24 of circuit 22.

A capacitor 60 is connected between the interconnected terminals of FET 56 and FET 58 and ground, and a capacitor 62 is connected between the drain of transistor 58 and ground.

Input 36 of circuit 22 is connected to the gate terminal of FET 56, and input 38 to circuit 22 is connected to the gate terminal of FET 58. FETs 56 and 58 operate in this circuit essentially as voltage control switches, with the resistance between the source and drain terminals of each of FET 56 and 58 controlled by the voltage level developed at the respective gate terminals thereof. The response of the switches to voltage supplied to the gate terminals thereof is not necessarily linear. A switch resistance may change between about 50 ohms and substantially infinite resistance.

As can be seen in FIG. 2, the signal connected to the gate terminal of FET 56 is the logic complement of the signal connected to the gate terminal of FET 58. As the output of clock 44 cycles from logic 1 to logic zero, the voltage developed at the gate terminals of each of FET 56 and 58, will cause the resistance value between the source and drain terminals of each of FETs 56 and 58 to alternate between high and low levels of resistance.

It will be noted that the keying signals developed on each line 18 will change from the logic level 1, corresponding to a nondepressed key, to a logic level zero corresponding to a depressed key, at end of scan when the corresponding key of manual 10 is depressed. Accordingly, the output of inverter 54 will change from logic level 1 to logic level zero in a sharp transition.

During the first low voltage portion of the output of clock 44, after the output of inverter 54 changes to logic level zero, the resistance between the source and drain terminals of FET 56 will be at a low value, and the voltage on capacitor 60 will begin to discharge through FET 56 toward the voltage level at the output of inverter 54.

As the output of clock 44 changes from the low voltage portion of the cycle thereof to the high voltage portion, the resistance between the source and drain terminal of FET 56 will return to a high level, while the resistance between the source and drain terminals of FET 58 will switch to a low level. With the resistance between the source and drain terminal of FET 58 at a low level, the voltage on capacitor 62 will discharge through FET 58 to capacitor 60.

As the signal at the output of clock 44 continues to oscillate between high and low voltage levels, it will be seen that the voltage on capacitors 60 and 62 will gradually discharge towards the voltage level developed at the output of inverter 54. The time interval required for the voltage on capacitor 62 to discharge fully to a value equal to the voltage level at the output of inverter 54 is determined by the frequency of the signal developed by clock 44, and by the ratio of the values, rather than the particular size, of capacitors 60 and 62.

Since only the ratio of the capacitance values is of importance, capacitance values of very small magnitude, for instance, 1 pico farad and 19 pico farad, respectively, can be used effectively to produce time constants of a magnitude suitable for use in timing the attack, and/or decay, of the keying signal developed by sustain circuit 22.

Since the capacitance values of capacitors 60 and 62 can be of a very small value, it now becomes possible to construct capacitors 60 and 62 within an integrated circuit chip, and thus avoid addition of timing capacitors external to the integrated circuit.

As mentioned previously, keyer circuitry 26 consists of a group of keyers, with each keyer controlling a respective output of tone generator 20. The particular keyer in FIG. 2 is indicated at 64.

It will be seen that keyer 64 essentially consists of a further pair of serially connected FETs 66 and 68. The respective tone signal developed by tone generator 20 is connected to the gate terminal of FET 66 and the keying signal developed at the respective line 24 of circuit 22 is connected to the gate terminal of FET 68. The value of the resistance between the source and drain terminals of each of FETs 66 and 68 is controlled, as is known, by the voltage level at the gate terminal thereof.

The signals from tone generator 20 are square waves and will correspondingly switch the conductivity of FET 66 from a high value to a low value at a respective frequency. The keying signal developed by circuit 22 and connected to the gate of FET 68, however, will not change from the high level to the low voltage level in a sharp transition. Rather, the voltage developed at the output of circuit 22 will change gradually from a high voltage level which causes the resistance between the source and the drain terminals of FET 66 to be high, towards a low voltage level, which causes the resistance between the source and the drain terminals of FET 68 to be low.

As will be seen in FIG. 2, the drain terminal of FET 68 is connected to the inverting input terminal of an operational amplifier 70. Operational amplifier 70 is provided with a feedback resistor 72 between the output terminal and the inverting input terminal thereof and will convert the signals developed at the drain terminal of FET 68 to voltage signals which are connected to the input of voicing circuits 28.

It will be noted that the output of clock 44 continuously oscillates, and that the resistance values presented by FETs 56 and 58 will also continuously oscillate between low and high values.

Accordingly, any time the output of inverter 54 changes from one logic level to the opposite logic level, the voltage developed on capacitors 60 and 62 will discharge, or charge, gradually toward the new voltage level developed at the output of inverter 54.

Further, it will be noted that the time constant involved in the change of the voltage on capacitor 62 will be the same regardless of the direction in which the voltage on capacitor 62 is changing.

The use of a single clock as shown in FIG. 2, and the resulting equal charge and discharge time constants, will create equal attack and decay wave forms of the signal developed at the output of amplifier 70.

Figure 3:
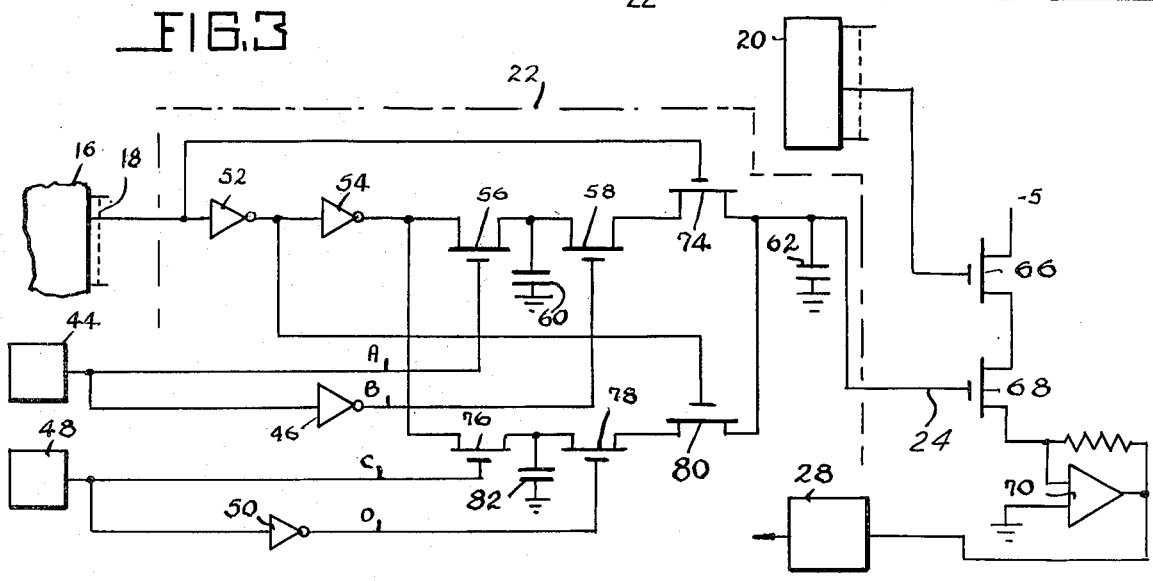
FIG. 3 is a schematic showing of a more complete circuit utilizing the circuit of the present invention.

In order to develop independent attack and decay time constants, the circuit shown in FIG. 3 is used.

Referring to FIG. 3, in which parts which are the same are numbered the same, it will be seen that the input from line 18 of demultiplexer circuit 16 is connected through inverters 52 and 54 to serially connected FETs 56 and 58 and capacitor 60, as already described in connection with FIG. 2. However, an additional FET 74 is used in the circuit of FIG. 3, in line 24 and has the source and drain terminals connected between the drain terminal of FET 58 and capacitor 62.

Also shown in FIG. 3, are FETs 76, 78 and 80, and capacitor 82 which are connected in a configuration identical to, and in parallel with, FETs 56, 58 and 74 and capacitor 60.

It will be noted, however, that the signal connected to the gate terminal of FET 74 is connected to the input of inverter 52, while the signal connected to the gate terminal of FET 80 is connected to the output of inverter 52. Accordingly, FET 74 will be switched to the low resistance state whenever a keying signal is developed at the respective line 18 of demultiplexer circuit 16, while FET 80 will be switched to the low resistance state whenever a nonkeying signal, namely, a logic 1 signal, is developed at the respective line 18 of demultiplexer circuit 16.

The use of FETs 74 and 80, as described above, makes it possible to establish the time constant of the discharge of the voltage of capacitor 62 by the use of FETs 56 and 58 and capacitor 60, while the time constant of the charging of voltage on capacitor 62 can be established by the use of FETs 76 and 78 and capacitor 82.

The clock inputs 40 and 42 to circuit 22, and which are labeled in FIG. 3 as phase C and phase D, are connected to the gate terminals of FETs 76 and 78, respectively.

The frequency of clock 48 can be set, for example, slower than the frequency of clock 44, and the time constant of the voltage change on capacitor 62 will be correspondingly slower when FETs 76 and 78 and capacitor 82 are enabled, by switching FET 80 to the low resistance level, as compared with the time constant of the voltage change on capacitor 62 when FETs 56 and 58 and capacitor 60 are enabled by switching FET 74 to the low resistance state.

It will be seen from the above description, and, in particular, from the description of the circuit of FIG. 3, that the circuit of the present invention provides a method of controlling the attack, and the decay, of the envelope of keyed tone signals without the use of expensive and cumbersome capacitors external to the integrated circuit. The entire keyer control circuit can, therefore, be manufactured within a single, or within a group, of integrated circuit chips.

From the foregoing description, it will be apparent that the FETs referred to are only one type of voltage sensitive or variable circuit components that could be employed for controlling current flow in the system. Relays and reed switches, for example, if designed to meet the frequency requirements could be used in the circuit. It is preferable, of course, for the envelope control circuitry to be in the form of an integrated circuit chip which could also include the keyer. In the case of an integrated circuit chip, FETs incorporated therein would be the preferred current control elements to have in the circuit.

All of the FETs referred to above are of the type in which the resistance goes low when the control signal to the gate terminal is low and while the resistance goes high when the voltage signal to the control gate is high.

It will also be apparent from the foregoing, that the rate of decay could be made different from the rate of attack in a single branch circuit, as shown in FIG. 2, by changing the clock frequency at the proper time. Thus, upon depression of a playing key, the clock would have one frequency and upon release of a playing key the clock would go to another frequency, thereby providing for the desired difference between the sustain and the decay.

It will also be evident from the foregoing, that, in most instances, a keyer signal supplied to the circuit of the present invention will go through a sustain period and will then remain steady as long as the respective playing key is depressed and will then go through a decay period when the playing key is released. During the steady state, the capacitors are charged to the same voltage but during both the sustain and decay periods, the capacitor charges and, therefore, the voltages, are changing incrementally as the FETs are pulsed.

While the particular clock frequency employed for supplying pulses to the gate terminals of the FETs in the circuit branches can be varied widely, it has been found that clock frequencies on the order of about 100 hertz will produce satisfactory and smooth sustain and decay sequences. Player adjustment of the clock frequency to vary the sustain and decay sequences is, of course, possible.

It will also be apparent that, apart from the keyer FETs, the FETs in the circuit operate substantially as switches and go from extremely low conductivity to extremely high conductivity abruptly when the signal to the gate terminal is changed from high to low. It will be apparent, however, that the conductivity of the FETs, in both directions, could be controlled by controlling the voltage of the pulses supplied to the gate terminals thereof, if so desired, so that the change between high and low conductivity of the transistor would fall between closer limits than otherwise.

In the preceding description, it is noted that the FETs described have been of the type that operates in the depletion mode, but it will be understood that FETs operating in the enhancement mode could readily be employed with a suitable change in the control voltage supplied to the gate terminals thereof.

It is further to be noted that the signals developed by inverters 52 and 54 have been referred to as being standard logic signals, but the particular voltages of the signals can consist of any voltages which can readily be distinguished.

Further, it will be appreciated that the signals developed by the keys could be either negative going or positive going and that, similarly, the actual keyers in the circuit could respond either to positive going or negative going signals as might be desired or convenient.

It will, thus, be apparent to anyone skilled in the art that the particular circuitry illustrated and described and the particular polarities and specific voltages are subject to wide variation without departing from the spirit of the invention and such variations are intended to be comprehended in the scope of the appended claims.

Modifications may be made within the scope of the appended claims.

What is claimed is:

1. In an electronic organ having sound signal generator means, transducer means, and a plurality of keyers interposed therebetween with each keyer having a voltage sensitive control terminal, a source of keyer actuating voltage, and keyboard means with playing keys depressible for connecting said source with said control terminals, envelope control circuitry interposed between said source and the respective keyer control terminal comprising: at least two serially connected variable current controlling elements forming at least one branch having one end connected to said source and the other end connected to the respective control terminal, first capacitor means connected between ground and the juncture of each adjacent pair of said elements, second capacitor means connected between ground and said other end of said branch, and control means operable for repetitively raising and lowering the conductivity of said elements sequentially such that, at substantially all times, two of said elements are at mutually opposite levels of conductivity.

2. An electronic organ according to claim 1 in which the element nearest said source is the first in which the conductivity is changed during a sequence and the element nearest said control terminal is the last.

3. An electronic organ according to claim 1 in which there are two of said elements in a branch and the control means is operable for alternately raising and lowering the conductivity of the elements.

4. An electronic organ according to claim 1 in which said control means comprises clock means supplying a series of pulses with one for each said element, each element having a control point connected to receive the respective pulse, said element going to a state of high conductivity during the respective pulse and to a state of low conductivity in the interval between successive ones of the respective pulses.

5. An electronic organ according to claim 4 in which each element is a field effect transistor with a source to drain path in said branch, and the control point comprises the gate terminal thereof.

6. In an electronic organ having sound signal generator means, transducer means and a plurality of keyers interposed therebetween with each keyer having a voltage sensitive control terminal, a source of keyer actuating voltage, and keyboard means with playing keys depressible for connecting said source with said control terminals, envelope control circuitry interposed between said source and the respective keyer control terminal comprising: at least two serially connected variable current controlling elements forming at least one branch having one end connected to said source and the other end connected to the respective control terminal, first capacitor means connected between ground and the juncture of each adjacent pair of said elements, second capacitor means connected between ground and said other end of said branch, and control means operable for repetitively raising and lowering the conductivity of said elements sequentially there being two said elements in said branch and said control means being operable for alternately raising and lowering the conductivity of said elements, said control means comprising clock means supplying a series of pulses for one of said elements and the inversion thereof for the other of said elements, each said element going to a state of high conductivity during the respective pulse and to a state of low conductivity in the interval between successive ones of the respective pulses.

7. An electronic organ according to claim 6 in which said control means comprises clock means supplying a series of pulses with one for each said element, each element having a control point connected to receive the respective pulse, said element going to one of the states of high and low conductivity during the respective pulse and to the other of said states in the interval between successive ones of the respective pulses.

8. An electronic organ according to claim 1 in which said capacitor means differ in size.

9. An electronic organ according to claim 1 in which said envelope control means comprises an integrated circuit chip having the said capacitor means integral therewith.

10. An electronic organ according to claim 1 in which each keyer comprises FET transistor means.

11. An electronic organ according to claim 1 in which each keyer comprises a pair of FET transistors with the source to drain serially connected in a path having a biasing voltage applied to one end and an amplifier connected to the other end, the sound signal source being connected to the gate of one of the pair of transistors and the gate of the other of the pair of transistors forming the keyer control terminal.

12. In an electronic organ having sound signal generator means, transducer means, a plurality of keyers interposed between the generator means and transducer means with each keyer having a voltage sensitive control terminal, a source of keyer actuating voltage, and keyboard means with playing keys depressible for connecting said source with said control terminals, the improvement being envelope control circuitry interposed between said source and the respective keyer control terminal comprising:

first and second circuit branches connected in parallel with one end of each branch being connected to said source and the other end connected to the respective control terminal, each said branch comprising at least two serially connected variable current controlling elements, first capacitor means connected between ground and the juncture of each adjacent pair of said elements, second capacitor means connected between ground and said other end of said branch, current control means for alternately raising and lowering the conductivity of the elements in the respective branch, and first and second switch means respectively in said first and second branches at the control terminal ends of said branches, and means for closing said first switch means while opening said second switch means in response to depression of a playing key and for opening said first switch means while closing said second switch means in response to releasing of the degressed playing key.

13. An electronic organ according to claim 12 in which at least the first capacitor means in each branch is a respective size to provide for respective rates of attack and decay of the keyed sound signal.

14. An electronic organ according to claim 12 in which each variable current controlling element is an FET transistor, said control means comprising a clock for each branch, each clock connected to supply pulses to the gate terminal of one of the pair of transistors in the respective branch and the inversion thereof to the gate terminal of the other of the pair of transistors.

15. An electronic organ according to claim 12 in which each switch means is an FET transistor and said means for actuating the switch means comprises a non-inverting connection from the respective source of keyer actuating voltage to the gate terminal of one of the transistors and an inverting connection to the gate terminal of the other of the transistors.

16. The method of controlling the envelope of a signal supplied to a voltage sensitive control terminal of a keyer interposed between a source of sound signals and a transducer from a source of keyer actuating voltage that changes abruptly between high and low values comprising: providing at least two voltage sensitive switches connected in series in a branch between the source of keyer actuating voltage and the control terminal, providing a first capacitor connected between ground and the side of one of said switches nearest the control terminal, providing a capacitor connected between ground and the side of the other of said switches nearest the control terminal, and alternately supplying voltage pulses to said switches for opening and closing said switches alternately, said switches being in opposite states at substantially all times.

17. The method according to claim 16 which includes providing two further voltage sensitive switches in series in a branch in parallel with the first mentioned branch, making one of the branches effective upon the source of keyer actuating voltage going high and making the other of the branches effective when the source of keyer actuating voltage goes low.

18. The method according to claim 17 which includes supplying voltage pulses to the switches of each branch at respective diverse rates.

19. In an electronic organ having tone generating means, transducer means, a plurality of keyers interposed between the tone generating means and the transducer means, each keyer having a control terminal, a source of keyer actuating voltage, and keyboard means with playing keys depressible for connecting the source of keyer actuating voltage with the respective keyer control terminals, the improvement being envelope control circuitry means comprising:

at least two serially connected first and second variable conductivity control elements forming a branch serially connected between said source of voltage and a respective said control terminal, first capacitor means connected between the juncture of said elements and a reference potential, said capacitor means connected between said branch and said reference potential at a point between said elements and said respective control terminal, and control means for cyclically maintaining the conductivity of said first element at a high level while at the same time maintaining the conductivity of said second element at low level and then maintaining the conductivity of said first element at a low level while at the same time maintaining the conductivity of said second element at a high level so as to cause said first capacitor means to charge through one of the elements and discharge through the other element each cycle of said control means, said elements being at opposite levels of conductivity at substantially all times.

20. The organ of claim 19 wherein said control means comprises clock means for supplying a series of pulses to one of said elements and the inversion thereof to the other element, each said element going to one of a state of high conductivity and a state of low conductivity during the respective pulse and the other of a state of high conductivity and a state of low conductivity in the interval between successive ones of the pulses.

21. The organ of claim 19 wherein said reference potential is ground potential.

22. The organ of claim 19 wherein said control circuitry comprises:

a second branch including third and fourth serially connected variable conductivity control elements forming a branch serially connected between said source of voltage and said respective control terminal, third and fourth capacitor means connected respectively between a reference potential and the juncture of said third and fourth elements and between said reference potential and said branch at a point between said third and fourth elements and said control terminal, and means for cyclically maintaining the conductivity of said third element at a high level while at the same time maintaining the conductivity of said fourth element at a low level and then maintaining the conductivity of said third element at a low level while at the same time maintaining the conductivity of said fourth element at a high level so as to cause said third capacitor means to charge through one of the third and fourth elements and discharge through the other of the third and fourth elements each cycle of said control neans, said third and fourth elements being at opposite levels of conductivity at substantially all times.

23. The organ of claim 19 including a plurality of said envelope control circuitry means operatively connected between said source of keyer actuated voltage and respective said keyers.

24. In an electronic organ having a plurality of keyers each including a control terminal, and keyboard controlled means with playing keys for selectively supplying a keyer actuating voltage to the control terminals of respective keyers, the improvement being envelope control circuitry means interposed between said keyboard controlled means and said keyers comprising:

an input terminal connected with said keyer actuating voltage, an output terminal connected with the control terminal of one of said keyers, first means for storing a voltage, second means connected to said output terminal for storing a voltage and holding said output terminal at said last mentioned voltage, third variable conductivity means connected between said first means and said input terminal for providing, when actuated, a path between said input terminal and said first means whereby the voltage level at said first terminal can be transferred to said first means, fourth variable conductivity means connected between said first and second means providing, when actuated, a path between said first and second means whereby the voltage level at said first means can be transferred to said second means, and means for repetitively and alternately actuating said third and fourth means to transfer the voltage level at said input through said first means to said second means by increments over a period of time, and wherein when one of said third or fourth means is activated, the other of said third or fourth means is deactivated.

25. The organ of claim 24 including a plurality of said envelope control circuitry means interposed between said keyer actuating voltage and respective said keyers.

26. The organ of claim 24 wherein said third and fourth means are serially connected field effect transistors, said first means is a capacitor connected between ground and the juncture of said field effect transistors, said second means is a capacitor connected between ground and said output terminal, and said means for actuating includes clock means for supplying pulses to the gates of said field effect transistors.

27. The organ of claim 19 wherein said point and said control terminal are at the same electrical potential.

28. In an electronic organ having tone generating means, transducer means, a plurality of keyers interposed between the tone generating means and the transducer means, each keyer having a control terminal, a source of keyer actuating voltage, and keyboard means with playing keys depressible for connecting the source of keyer actuating voltage with the respective keyer control terminals, the improvement being envelope control circuitry means comprising:

at least two serially connected first and second variable conductivity control elements forming a branch serially connected between said source of voltage and a respective said control terminal, first capacitor means connected between a reference potential and a point located serially between said elements, second capacitor means connected between said reference potential and one end of said branch, said one end being the end of said branch electrically most proximate to said control terminal, and control means for repetitively maintaining the conductivity of said first element at a high level while at the same time maintaining the conductivity of said second element at a low level and then maintaining the conductivity of said first element at a low level while at the same time maintaining the conductivity of said second element at a high level so as to cause said first capacitor means to charge through one of the elements and discharge through the other element each cycle of said control means said elements being at opposite levels of conductivity at substantially all times.

* * * * *